US005143890A

United States Patent [19]

Tsuchida et al.

[11] Patent Number: 5,143,890

[45] Date of Patent: Sep. 1, 1992

[54] HEAT SENSITIVE RECORDING MATERIAL

[75] Inventors: Tetsuo Tsuchida, Takarazuka; Yukihiro Abe, Kobe; Tomoyuki Okimoto, Nishinomiya; Toranosuke Saito, Ibaraki, all of Japan

[73] Assignees: Kanzaki Paper Manufacturing Co., Ltd.; Sanko Kaihatsu Kagaku Kenkyusho Corporation, both of Tokyo, Japan

[21] Appl. No.: 617,110

[22] Filed: Nov. 21, 1990

[30] Foreign Application Priority Data

Nov. 30, 1989 [JP] Japan ..... 1-313789

[51] Int. Cl.[5] ..... B41M 5/30

[52] U.S. Cl. ..... 503/201; 503/208; 503/209; 503/221

[58] Field of Search ..... 503/208, 209, 225, 201, 503/221; 427/150–152

[56] References Cited

U.S. PATENT DOCUMENTS 4,531,140 7/1985 Suzuki et al. ..... 503/209

*Primary Examiner*—Pamela R. Schwartz

*Attorney, Agent, or Firm*—Armstrong & Kubovcik

[57] ABSTRACT

The present invention provides a heat sensitive recording material, including a substrate and a heat sensitive recording layer thereon incorporating a colorless or light-colored basic dye and a color acceptor reactive with the dye to form a color when contacted therewith, the recording material also including 1-(4-methoxyphenoxy)-2-(2-methylphenoxy)ethane in the heat sensitive recording layer.

8 Claims, No Drawings

HEAT SENSITIVE RECORDING MATERIAL

The present invention relates to a heat sensitive recording material, and more particularly to a heat sensitive recording material which produces record images having high color density with application of a small quantity of energy.

Heat sensitive recording materials are well known which are adapted to produce record images by thermally contacting a colorless or light-colored basic dye with an organic or inorganic color acceptor for a color forming reaction.

With remarkable progress in heat sensitive recording systems in recent years, thermal facsimile systems, etc. are made operable at a high speed. For example, thermal facsimile systems produce a copy of A4 size within 10 seconds. For use with such high-speed hardware, heat sensitive recording materials must meet the requirements of high-speed recording.

In order to enhance the recording sensitivity of the heat sensitive recording material, it is conventionally known to add to a recording layer a heat-fusible substance having a lower melting point than both of a basic dye and a color acceptor and to dissolve the dye and the color acceptor into the molten heat-fusible substance to lower a color formation commencing temperature (J P-A-49-34842, J P-A-53-39139, etc.). The term "J P-A" means an "unexamined published Japanese patent application". However, it is difficult that a single heat-fusible substance dissolves both of a basic dye and a color acceptor therein. Further, even when a molten mixture of a dye, color acceptor and heat-fusible substance is obtained, color formation commencing temperature lowers excessively due to a melting point depression by co-melting of the three compounds, which accompanies a defect that whiteness of a recording layer markedly decreases.

We have previously proposed diaryloxyalkane derivative as a heat-fusible substance which is free from the above defect (J P-A-60-56588, J P-A-61-16888 and U.S. Pat. No. 4,531,140).

However, in the field of thermal facsimiles and like hardwares, the device is rapidly required to be small-sized in addition to high-speed recording. With this tendency, a heat sensitive recording material is strongly demanded which can produce record images having high color density in high recording sensitivity even with application of small quantity of heat (heat energy).

In view of the above situation, we have widely investigated a heat-fusible substance in order to obtain a heat sensitive recording material which colors in high density even with a small amount of heat energy and does not lower in whiteness. As a result, we have found that the above object is achieved by selectively using 1-(4-methoxyphenoxy)-2-(2-methylphenoxy)ethane as a heat-fusible substance. The present invention is accomplished by the above finding.

The present invention provides a heat sensitive recording material comprising a substrate and a heat sensitive recording layer thereon incorporating a colorless or light-colored basic dye and a color acceptor reactive with the dye to form a color when contacted therewith, the recording material being characterized in that 1-(4-methoxyphenoxy)-2-(2-methylphenoxy)ethane is contained in the heat sensitive recording layer.

In the present invention, it is still remained to be clarified why a heat sensitive recording material which is excellent in color forming ability particularly in a low-energy range is obtained by use of 1-(4-methoxyphenoxy)-2-(2-methylphenoxy)ethane. It is presumed that the above compound is particularly low in heat of fusion and melt viscosity compared with other diaryloxyalkane derivatives, and also exhibits extremely high mutual solubility with a basic dye and/or color acceptor.

In the present heat sensitive recording material, the amount of 1-(4-methoxyphenoxy)-2-(2-methylphenoxy)ethane is not necessarily limited but is usually 10 to 700 parts by weight, preferably 50 to 500 parts by weight per 100 parts by weight of the basic dye.

In the present invention, various dyes are known as the colorless or light-colored basic dye which is contained in the recording layer of the heat sensitive recording material. Examples thereof are:

Triarylmethane-based dyes, e.g., 3,3-bis(p-dimethylaminophenyl)-6-dimethylaminophthalide, 3,3-bis(p-dimethylaminophenyl)phthalide, 3-(4-dimethylaminophenyl)-3-(4-diethylamino-2-methylphenyl)-6-(dimethylamino)phthalide, 3-(p-dimethylaminophenyl)-3-(1,2-dimethylindole-3-yl)-phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide, etc.

Diphenylmethane-based dyes, e.g., 4,4'-bis-dimethylaminobenzhydryl benzyl ether, N-halophenylleucoauramine, N-2,4,5-trichlorophenyl-leucoauramine, etc.

Divinylphthalide-based dyes, e.g., 3,3-bis [1,1-bis(4-pyrrolidinophenyl)ethylene-2-yl]-4,5,6,7-tetrabromophthalide, 3,3-bis[1-(4-methoxyphenyl)-1-(4-dimethylaminophenyl)ethylene-2-yl]-4,5,6,7-tetrachlorophthalide, 3,3-bis[1-(4-methoxyphenyl)-1-(4-pyrrolidinophenyl)ethylene-2-yl]-4,5,6,7-tetrachlorophthalide, etc.

Thiazine-based dyes, e.g., benzoyl-leucomethyleneblue, p-nitrobenzoyl-leucomethyleneblue, etc.

Spiro-based dyes, e.g., 3-methyl-spiro-dinaphthopyran, 3-ethyl-spiro-dinaphthopyran, 3-phenylspiro-dinaphthopyran, 3-benzyl-spiro-dinaphthopyran, 3-methyl-naphtho(6'-methoxybenzo)spiropyran, 3-propyl-spirodibenzopyran, etc.

Lactam-based dyes, e.g., rhodamine-B-anilinolactam, rhodamine(p-nitroanilino)lactam, rhodamine-(o-chloroanilino)lactam, etc.

Fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-(N-methyl-N-benzylamino)-fluoran, 3-diethylamino-7-(N-chloroethyl-N-methylamino)fluoran, 3-diethylamino-7-N-diethylaminofluoran, 4-benzylamino-8-diethylaminobenzo[a]fluoran, 3-[4-(4-dimethylaminoanilino)anilino]-7-chloro-6-methylfluoran, 8-[4-(4-dimethylaminoanilino)anilino]-benzo[a]fluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-di-n-butylamino-6-methyl-7-phenylaminofluoran, 3-di-n-pentylamino-6-methyl-7-phenylaminofluoran, 3-diethylamino-7-(2-carbomethoxyphenylamino)fluoran, 3-(N-ethyl-N-isoamylamino)-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)-fluoran, 3-di-n-butylamino-7-(o-chlorophenylamino)fluoran, 3-(N-ethyl-N-tetrahydrofurfurylamino)-6-methyl-7-phenylaminofluoran, 3-(N-methyl-N-n-propylamino)-6-methyl-7-phenylaminofluoran, 3-(N-ethyl-N-isobutylamino)-6-methyl-7-phenylaminofluoran, 3-(N-methyl-N-n-hexylamino)-6-methyl-7-phenylaminofluoran, 3-(N-ethyl-N-n-hexylamino)-6-methyl-7-phenylaminofluoran, 3-(N-ethyl-N-cyclopentylamino)-6-methyl-7-phenylaminofluoran, etc.

Fluorene-based dyes, e.g., 3,6-bis(dimethylamino)-fluorene-9-spiro-3'-(6'-dimethylamino)phthalide, 3-diethylamino-6-(N-allyl-N-methylamino)fluorene-9-spiro-3'-(6'-dimethylamino)phthalide, 3,6-bis(dimethylamino)-spiro-[fluorene-9,6'-6'H-chromeno(4,3-b)indole], 3,6-bis-(dimethylamino)-3'-methyl-spiro[fluorene-9,6'-6'H-chromeno(4,3-b)indole], 3,6-bis(diethylamino)-3'-methyl-spiro[fluorene-9,6'-6'H-chromeno(4,3-b)indole], etc. These basic dyes are not limited to thereabove and can be used, as required, in a mixture of at least two of them.

Among the above basic dyes, particularly preferably used is at least one of 3-di-n-butylamino-6-methyl-7-phenylaminofluoran, 3-di-n-pentylamino-6-methyl-7-phenylaminofluoran and 3-di-n-butylamino-7-(o-chlorophenylamino)fluoran. With these preferable basic dyes, the specific heat-fusible substance of the present invention exhibits sufficiently its characteristics of low melt viscosity, the adhesion of tailings to a thermal head and the record deficiency (production of unrecorded portion) hardly occur, and a heat sensitive recording material can be obtained which does not lower in whiteness even when exposed at high temperature. The above heat sensitive recording material which employs a specific basic dye hardly accompanies the adhesion of tailings and the record deficiency, and has excellent characteristics that the material is useful not only for a usual thermal facsimile or thermal printer but also for a thermal recording device for an electrocardiogram which is relatively apt to entail the adhesion of tailings.

In the present invention, a substance which acts as a Brønsted acid or Lewis acid is preferably used as a color acceptor contained in the recording layer of the heat sensitive recording material. Examples thereof are:

Inorganic color acceptors:

Acidic clay, activated clay, attapulgite, bentonite, colloidal silica, aluminum silicate, magnesium silicate, zinc silicate, tin silicate, calcined kaolin and talc.

Organic color acceptors:

Aliphatic carboxylic acids, e.g., oxalic acid, maleic acid, tartaric acid, citric acid, succinic acid and stearic acid.

Aromatic carboxylic acids, e.g., benzoic acid, 4-chlorobenzoic acid, p-nitrobenzoic acid, 4-methyl-3-nitrobenzoic acid, 2-chloro-4-nitrobenzoic acid, 2,4-dinitrobenzoic acid, p-tert-butylbenzoic acid, phthalic acid, gallic acid, salicylic acid, 3-isopropylsalicylic acid, 3-phenylsalicylic acid, 3-cyclohexylsalicylic acid, 3,5-di-tert-butylsalicylic acid, 3-methyl-5-benzyl-salicylic acid, 3-phenyl-5-($\alpha$,$\alpha$-dimethylbenzyl)salicylic acid, 3,5-di-($\alpha$-methylbenzyl)salicylic acid, 4-[2-(p-methoxyphenoxy)ethoxy]salicylic acid, 2-hydroxy-1-benzyl-3-naphthoic acid, tetrachlorophthalic acid monoethyl ether and indole-2-carboxylic acid.

Phenolic compounds, e.g., 4,4'-isopropylidenediphenol, 4,4'-isopropylidenebis(2-chlorophenol), 4,4'-isopropylidenebis(2,6-dichlorophenol), 4,4'-isopropylidenebis(2,6-dibromophenol), 4,4'-isopropylidenebis-(2-methylphenol), 4,4'-isopropylidenebis(2,6-dimethylphenol), 4,4'-isopropylidenebis(2-tert-butylphenol), 4,4'-sec-butylidenediphenol, 2,2-bis(4-hydroxyphenyl)-4-methylpentane, 4,4'-(1-phenylethylidene)diphenol, 4,4'-cyclohexylidenediphenol, 4,4'-cyclohexylidenebis(2-methylphenol), 4-tert-butylphenol, 4-phenylphenol, 4-hydroxydiphenoxide, $\alpha$-naphthol, $\beta$-naphthol, methyl 4-hydroxybenzoate, benzyl 4-hydroxybenzoate, dimethyl 4-hydroxyphthalate, 2,2'-thiobis(4,6-dichlorophenol), 4-tert-octylcatechol, 2,2'-methylenebis(4-chlorophenol), 2,2'-methylenebis(4-methyl-6-tertbutylphenol), 2,2'-dihydroxydiphenyl, methylbis(4-hydroxyphenyl)acetate, ethylbis(4-hydroxyphenyl)acetate, benzylbis-(4-hydroxyphenyl)acetate, butylbis(4-hydroxyphenyl)acetate, 4,4'-(p-phenylenediisopropylidene)diphenol, 4,4'-(m-phenylenediisopropylidene)diphenol, 4,4'-dihydroxydiphenylsulfone, 2,4'-dihydroxydiphenylsulfone, 4-hydroxydiphenylsulfone, 4-hydroxy-4'-methyldiphenylsulfone, 3,3'-diallyl-4,4'-dihydroxydiphenylsulfone, 4-hydroxy-3',4'-tetramethylenediphenylsulfone, 4-hydroxy-4'-isopropoxydiphenylsulfone, 1,7-bis(4-hydroxyphenylthio)-3,5-dioxaheptane, 1,5-bis(4-hydroxyphenylthio)-3-oxapentane, 1,1,3-tris(2-methyl-4-hydroxy-5-tert-butylphenyl)butane and 1,1,3-tris(2-methyl-4-hydroxy-5-cyclohexylphenyl)butane.

Phenolic resins, e.g., p-phenylphenol-formalin resin and p-butylphenol-acetylene resin.

Salt of the organic color acceptor with a polyvalent metal such as zinc, magnesium, aluminum, calcium, titanium, manganese, tin and nickel.

Thiourea compounds, e.g., 1,3-diphenyl-2-thiourea and 1,3-bis(m-chlorophenyl)-2-thiourea.

Metal complex e.g., antipyrine complex with zinc thiocyanate.

These color acceptors are used, as required, in a mixture of at least two of them.

The proportions of the basic dye and color acceptor in the heat sensitive recording layer are not particularly limited but usually 100 to 700 parts by weight, preferably 150 to 600 parts by weight, of the color acceptor is used per 100 parts by weight of the basic dye.

For preparing a coating composition comprising the foregoing components, the dye, the color acceptor and the specific heat-fusible substance are dispersed, together or individually, into water serving as a dispersion medium, using stirring and pulverizing means such as a ball mill, attritor, sand mill or the like.

Usually the coating composition has incorporated therein a binder in an amount of 10 to 40% by weight, preferably 15 to 30% by weight, based on the total solids content of the composition. Examples of useful binders are starches, hydroxyethyl cellulose, methyl cellulose, carboxymethyl cellulose, gelatin, casein, gum arabic, polyvinyl alcohol, styrene-maleic anhydride copolymer salt, styrene-acrylic acid copolymer salt, styrene-butadiene copolymer emulsion, etc.

Various other auxiliary agents can be further added to the coating composition. Examples of useful agents are dispersants such as sodium dioctylsulfosuccinate, sodium dodecylbenzenesulfonate, sodium lauryl sulfate, fatty acid metal salts, etc., ultraviolet absorbers such as triazole compounds, defoaming agents, fluorescent dyes, coloring dyes, etc. Further, to the composition may be added, in order to prevent sticking upon contact of the heat sensitive recording material with a recording device or thermal head, a dispersion or emulsion of stearic acid, polyethylene, carnauba wax, paraffin wax, zinc stearate, calcium stearate, ester wax or the like.

In addition, to the composition may be added in order to prevent the adhesion of tailings to the thermal head, inorganic pigment such as kaolin, clay, talc, calcium carbonate, calcined clay, titanium oxide, kieselguhr, finely divided anhydrous silica, activated clay, etc.

The present invention, as stated above, is characterized in that the above specific heat-fusible substance is used. It is possible, however, to use conjointly, in an amount which does not cause adverse effect, other heat-fusible substances. Examples thereof are aliphatic fatty acid amide such as stearic acid amide, stearic acid methylenebisamide, oleic acid amide, palmitic acid amide, coconut fatty acid amide, etc; ethers such as 1,2-diphenoxyethane, 1,2-bis(4-methylphenoxy)ethane, 1,2-bis(3-methylphenoxy)ethane, 1,3-bis(4-methoxyphenoxy)propane, 1,4-bis(phenylthio)butane, 1,5-bis(4-methoxyphenoxy)-3-oxapentane, 2-benzyloxynaphthalene, 1,4-bis[2-(vinyloxy)-ethoxy]benzene, etc; esters such as dibenzyl terephthalate, 1-hydroxy-2-naphthoic acid phenyl ester, 1,2-bis(4-benzyloxycarbonylphenoxy)ethane, dibenzyl oxalate, di-(p-methylbenzyl) oxalate, di-(p-chlorobenzyl) oxalate, benzyl p-benzyloxybenzoate, etc; and aromatic compounds such as m-terphenyl, p-benzylbiphenyl, etc.

As a substrate (support) to be coated, may be used a paper, plastic film, synthetic fiber sheet or the like, but a paper is most preferably used from a viewpoint of cost, coating applicability, etc. The amount of coating composition forming the recording layer to be applied to the support, which is not limited particularly, is usually about 2 to 12 g/m$^2$, preferably about 3 to 10 g/m$^2$, based on dry weight.

The heat sensitive recording materials thus obtained are excellent in color forming ability, particularly in a low-energy range and in whiteness of the recording layer, and are free from the adhesion of tailings (piling) on the thermal head, due to a selective use of specific heat-fusible substance.

Further, it is possible to form an over-coat layer on the recording layer to protect the layer. Various other known techniques in the field of heat sensitive recording material can be applied. For example, it is possible to form a protective layer on the rear surface of the support, to form a primary coating layer (intermediate layer) on the support, to form an adhesive layer on the rear surface of the support.

The invention will be described below in more detail with reference to Examples. However, the invention is not limited only to the examples given below. In the following, parts and percentages are all by weight, unless otherwise specified.

EXAMPLE 1

Formation of an intermediate layer

| | |
|---|---|
| Calcined clay (trade name: Ansilix, apparent specific gravity: 0.22 g/cm$^3$, Engelhard Minerals & Chemicals Corp.) | 100 parts |
| Styrene-butadiene copolymer latex (solids: 50%) | 15 parts |
| 10% Aqueous solution of polyvinyl alcohol | 30 parts |
| Water | 200 parts |

These components were mixed to prepare a coating composition for an intermediate layer. To a paper substrate weighing 50 g/m$^2$ was applied and dried the above coating composition in an amount of 10 g/m$^2$ by dry weight to form an intermediate layer.

Preparation of a Heat Sensitive Recording Paper

① Composition (A)

| | |
|---|---|
| 3-Di-n-butylamino-6-methyl-7-phenylaminofluoran | 10 parts |
| 1-(4-Methoxyphenoxy)-2-(2-methylphenoxy)ethane | 20 parts |
| 5% Aqueous solution of methyl cellulose | 15 parts |
| Water | 120 parts |

These components were pulverized by a sand mill to prepare Composition (A) having an average particle size of 3 μm.

② Composition (B)

| | |
|---|---|
| 4,4'-Isopropylidenediphenol | 30 parts |
| 5% Aqueous solution of methyl cellulose | 30 parts |
| Water | 70 parts |

These components were pulverized by a sand mill to prepare Composition (B) having an average particle size of 3 μm.

③ Formation of a recording layer

A coating composition for a heat sensitive recording layer was prepared by mixing with stirring 165 parts of Composition (A), 130 parts of Composition (B), 30 parts of finely divided anhydrous silica (oil absorption 180 ml/100 g), 150 parts of 20% aqueous solution of oxidized starch and 55 parts of water. To the above intermediate layer was applied and dried the above coating composition in an amount of 5.0 g/m$^2$ by dry weight to obtain a heat sensitive recording paper.

EXAMPLES 2 TO 4

Three kinds of heat sensitive recording papers were prepared in the same manner as in Example 1 excecpt that, in the preparation of Composition (B), 4-hydroxy-4'-isopropoxydiphenylsulfone (Example 2), butylbis(4-hydroxyphenyl)acetate (Example 3) or 4,4'-(m-phenylenediisopropylidene)diphenol (Example 4) was used in place of 4,4'-isopropylidenediphenol.

EXAMPLES 5 TO 7

Three kinds of heat sensitive recording papers were prepared in the same manner as in Example 1 except that, in the preparation of Composition (A), 3-di-n-pentylamino-6-methyl-7-phenylaminofluoran (Example 5), 3-(N-ethyl-N-isoamylamino)-6-methyl-7-phenylaminofluoran (Example 6) or 3-di-n-butylamino-7-(o-chlorophenylamino)fluoran (Example 7) was used in place of 3-di-n-butylamino-6-methyl-7-phenylaminofluoran.

EXAMPLE 8

A heat sensitive recording paper was prepared in the same manner as in Example 3 except that, in the preparation of Composition (A), 3-(N-ethyl-N-isoamylamino)-6-methyl-7-phenylaminofluoran was used in place of 3-di-n-butylamino-6-methyl-7-phenylaminofluoran.

COMPARISON EXAMPLES 1 TO 3

Three kinds of heat sensitive recording papers were prepared in the same manner as in Example 1 except that, in the preparation of Composition (A), stearic acid amide (Comparison Example 1), 1,2-diphenoxyethane (Comparison Example 2) or 1,2-bis(3-methylphenoxy)ethane (Comparison Example 3) was used in place of 1-(4-methoxyphenoxy)-2-(2-methylphenoxy)ethane.

The eleven kinds of heat sensitive recording papers thus obtained were used for recording on a thermal facsimile simulator (TH-PMD, a product of Ohkura Electronic Co., Ltd.) with an application of heat energy of 0.17, 0.21, 0.25 or 0.29 mJ/dot at 24 V and pulse cycle of 5 msec. The color density of the images recorded was measured by a Macbeth reflective densitometer (Model RD-100R, a product of Macbeth Corp.) with an amber filter. The results were given in Table 1.

Further, each of the heat sensitive recording papers was checked for color density in the background area of the recording layer before recording and after heat treatment (60° C., 12 hours) similarly with use of Macbeth reflective densitometer. Table 1 also shows the results.

Further, the heat sensitive recording material is checked for the adhesion of tailings to a thermal head by the following two methods. The results were also shown in Table 1.

Method A

Five sheets of A4-size heat sensitive recording papers were used for printing a 100% solid black image on a thermal facsimile (NEFAX-27, a product of NEC Corp.) and checked for the adhesion of tailings to the thermal head and for printing deficiency of the record image with the unaided eye.

Method B

A roll having 10 m-length of a heat sensitive recording paper was used for printing a 100% solid black image on a thermal recording device for an electrocardiogram (Thermal Array Recorder, a product of Nihon Koden Kogyo Co., Ltd.) at a recording speed of 25 mm/min., and checked for the adhesion of tailings to the thermal head and for printing deficiency of the record image with the unaided eye.

The check results were evaluated according to the following criteria.

◎: No adhesion of tailings to the thermal head and excellent in the record image ○: Slight adhesion of tailings to the thermal head but excellent in the record image, and practically no problem Δ: Considerable adhesion of tailings to the thermal head and slightly uneven in the record image X: Marked adhesion of tailings to the thermal head and non-printing portion present in the record image, and unsuited to practical use

Effects

As apparent from Table 1, the heat sensitive recording materials of the present invention are excellent in color forming ability in a low-energy range, low in the decrease of whiteness when exposed at high temperatures and hardly accompany the adhesion of tailings to a thermal head and the record deficiency.

TABLE 1

| | Color density | | | | Color density of background area | | Adhesion of tailings | |
|---|---|---|---|---|---|---|---|---|
| | 0.17 mJ/dot | 0.21 mJ/dot | 0.25 mJ/dot | 0.29 mJ/dot | no treatment | after heat treatment | method A | method B |
| Ex. 1 | 0.60 | 1.04 | 1.29 | 1.32 | 0.06 | 0.10 | ◎ | ◎ |
| Ex. 2 | 0.65 | 1.08 | 1.30 | 1.32 | 0.05 | 0.09 | ◎ | ◎ |
| Ex. 3 | 0.55 | 1.02 | 1.28 | 1.30 | 0.05 | 0.09 | ◎ | ◎ |
| Ex. 4 | 0.59 | 1.00 | 1.29 | 1.32 | 0.06 | 0.09 | ◎ | ◎ |
| Ex. 5 | 0.58 | 1.03 | 1.29 | 1.31 | 0.05 | 0.09 | ◎ | ○ |
| Ex. 6 | 0.57 | 1.01 | 1.27 | 1.30 | 0.06 | 0.18 | ○ | Δ |
| Ex. 7 | 0.56 | 1.01 | 1.28 | 1.31 | 0.05 | 0.08 | ◎ | ◎ |
| Ex. 8 | 0.52 | 0.99 | 1.26 | 1.29 | 0.07 | 0.17 | ○ | Δ |
| Com. Ex. 1 | 0.17 | 0.38 | 0.73 | 1.04 | 0.08 | 0.08 | X | X |
| Com. Ex. 2 | 0.31 | 0.64 | 0.93 | 1.20 | 0.06 | 0.08 | ○ | X |
| Com. Ex. 3 | 0.33 | 0.68 | 0.95 | 1.21 | 0.06 | 0.08 | ○ | X |

We claim:

1. A heat sensitive recording material comprising a substrate and a heat sensitive recording layer thereon incorporating a colorless or light-colored basic dye and a color acceptor reactive with the dye to form a color when contacted therewith, the recording material being characterized in that 1-(4-methoxyphenoxy)-2-(2-methylphenoxy)ethane is contained in the heat sensitive recording layer.

2. A heat sensitive recording material as defined in claim 1 wherein 1-(4-methoxyphenoxy)-2-(2-methylphenoxy)ethane is contained in an amount of 10 to 700 parts by weight per 100 parts by weight of the basic dye.

3. A heat sensitive recording material as defined in claim 1 wherein the basic dye is at least one selected from the group consisting of 3-di-n-butylamino-6-methyl-7-phenylaminofluoran, 3-di-n-pentylamino-6-methyl-7-phenylaminofluoran, 3-(N-ethyl-N-isoamylamino)-6-methyl-7-phenylaminofluoran and 3-di-n-butylamino-7-(o-chlorophenylamino)fluoran.

4. A heat sensitive recording material as defined in claim 1 wherein the color acceptor is used in an amount of 100 to 700 parts by weight per 100 parts by weight of the basic dye.

5. A method of rapid recording of information on a heat sensitive recording material by selective application of a minimal amount of thermal energy, comprising providing a heat sensitive recording material comprising a substrate and a heat sensitive recording layer comprising a colorless or light-colored basic dye, a color acceptor reactive with the dye to form a color when contacted therewith, and 1-(4-methoxyphenoxy)-2-(2-methylphenoxy)ethane;

passing said heat sensitive recording material through an apparatus for selectively supplying thermal energy at predetermined location dots across a width of said apparatus;

selectively applying an amount of thermal energy to said recording material which is effective to record information at a high color density, wherein said amount of thermal energy is no greater than 0.29 mJ/dot.

6. The method of claim 5, wherein said 1-(4-methoxyphenoxy)-2-(2-methylphenoxy)ethane is present in said recording layer in an amount of 10 to 700 parts by weight per 100 parts by weight of said basic dye.

7. The method of claim 5, wherein said basic dye is at least one member selected from the group consisting of 3-di-n-butylamino-6-methyl-7-phenylaminofluran, 3-di-n-pentylamino-6-methyl-7-phenylaminofluoran, 3,3-(N-ethyl-N-isoamylamino)-6-methyl-7-phenylaminofluoran and 3-di-n-butylamino-7-(o-chlorophenylamino) fluoran.

8. The method of claim 5, wherein said color acceptor is present in said recording layer in an amount of from 100 to 700 parts by weight of said basic dye.

* * * * *